US007401567B2

(12) United States Patent
Park

(10) Patent No.: US 7,401,567 B2
(45) Date of Patent: Jul. 22, 2008

(54) BUILT-UP TYPE BOAT

(76) Inventor: Sun-Jae Park, B-101 Songrim Villa, 180-16, Songjeong-dong, Haeundae-gu, Busan Metropolitan City 612-040 (KR)

( * ) Notice: Subject to any disclaimer, the term of this patent is extended or adjusted under 35 U.S.C. 154(b) by 0 days.

(21) Appl. No.: 10/583,319

(22) PCT Filed: Dec. 8, 2004

(86) PCT No.: PCT/KR2004/003207

§ 371 (c)(1),
(2), (4) Date: Jun. 13, 2006

(87) PCT Pub. No.: WO2005/061320

PCT Pub. Date: Jul. 7, 2005

(65) Prior Publication Data

US 2007/0169679 A1 Jul. 26, 2007

(30) Foreign Application Priority Data

Dec. 22, 2003 (KR) ..... 10-2003-0094633

(51) Int. Cl.
*B63B 7/06* (2006.01)
*B63B 7/08* (2006.01)

(52) U.S. Cl. ..... 114/354; 114/345; 114/352

(58) Field of Classification Search ..... 114/345, 114/347, 352, 354
See application file for complete search history.

(56) References Cited

U.S. PATENT DOCUMENTS 2,443,768 A * 6/1948 House ..... 114/352
3,049,731 A * 8/1962 Ertl et al. ..... 114/354
3,490,085 A * 1/1970 Lewis ..... 114/345
3,742,893 A * 7/1973 Stelling ..... 440/42
4,730,573 A * 3/1988 Koon ..... 114/353
4,821,666 A * 4/1989 Ingram ..... 114/347
4,841,899 A * 6/1989 Fleckles et al. ..... 114/347
5,477,804 A 12/1995 Chan ..... 114/354
6,263,827 B1 * 7/2001 Szigeti ..... 114/354

FOREIGN PATENT DOCUMENTS

| | | |
|---|---|---|
| JP | 03-42490 | 2/1991 |
| KR | 95-8785 | 4/1995 |
| KR | 10-2003-0010961 | 2/2003 |

* cited by examiner

*Primary Examiner*—Sherman Basinger
(74) *Attorney, Agent, or Firm*—J.C. Patents

(57) ABSTRACT

The present invention relates to a prefabricated boat. The prefabricated boat comprises a body part being composed of a plurality of division members capable of being assembled, an armor part for wrapping around and fixing the body part assembled into a single body, and an air tube mounted on a desired position of the inner face of the armor part. The armor part has the form of a bag and is provided with an opening for receiving the plurality of division members constituting the body part. Air is injected into the air tube to expand it in the state that the armor part wraps around the body part. Due to the expansion force of the air tube, the division members constituting the body part are fixed firmly, thereby preventing the relative movements between the division members.

7 Claims, 3 Drawing Sheets

【FIG. 1a】
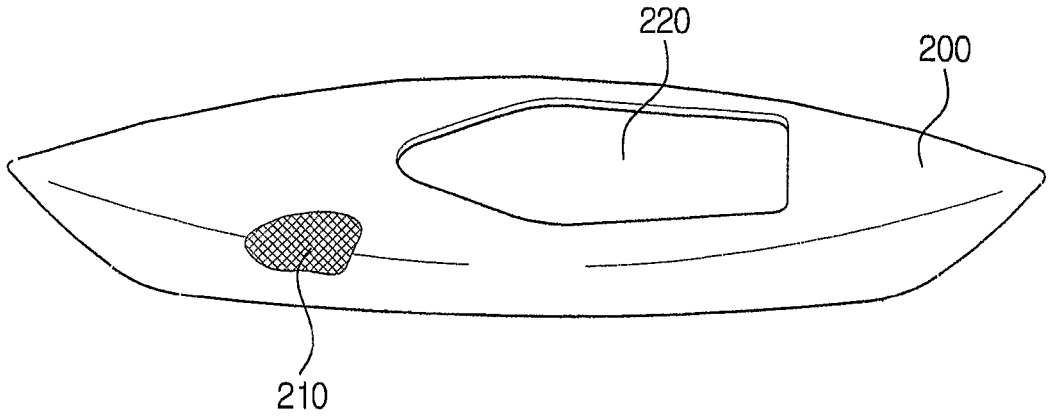
【FIG. 1b】
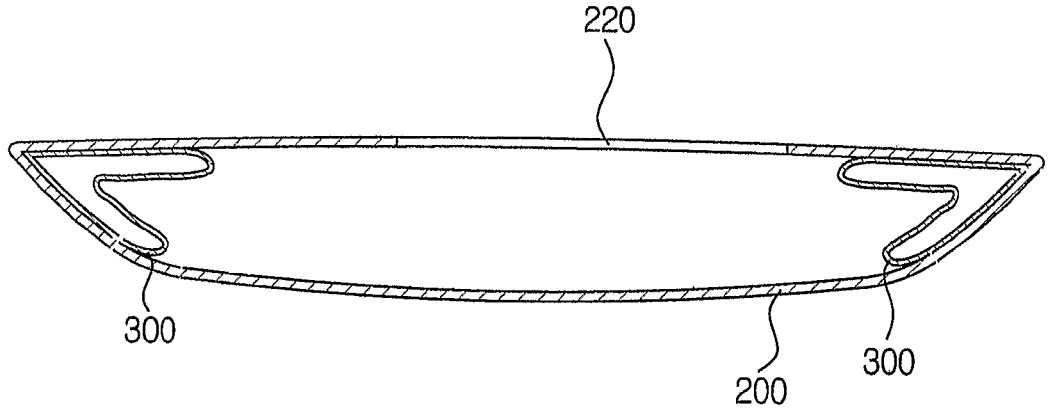

【FIG. 2】
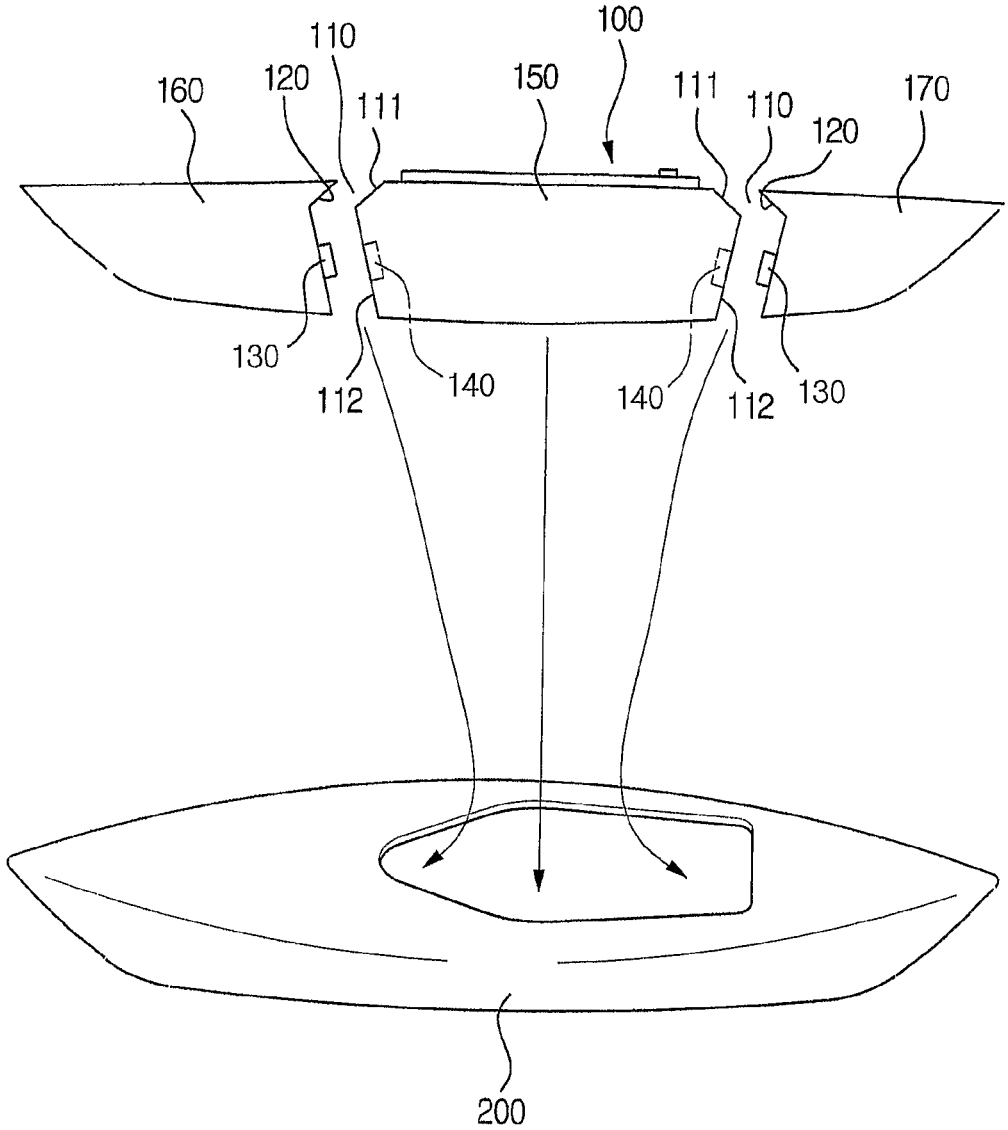

【FIG. 3】
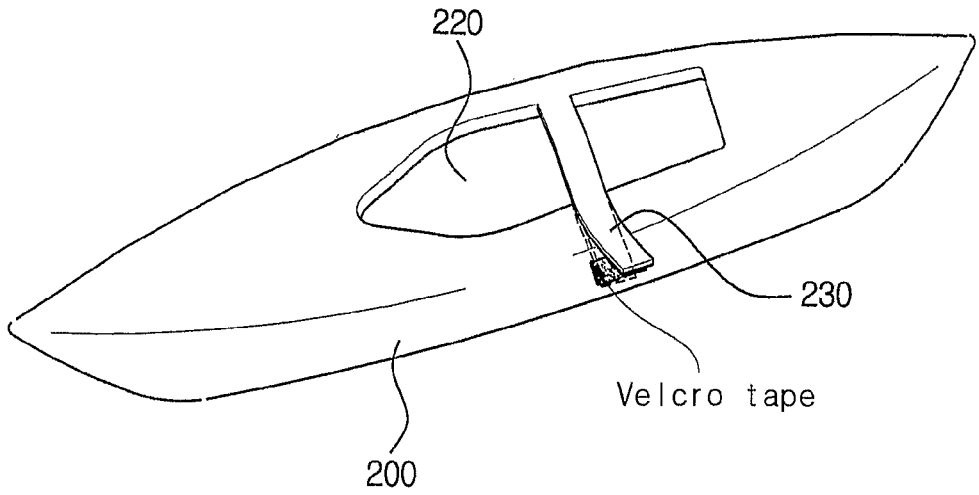
【FIG. 4】
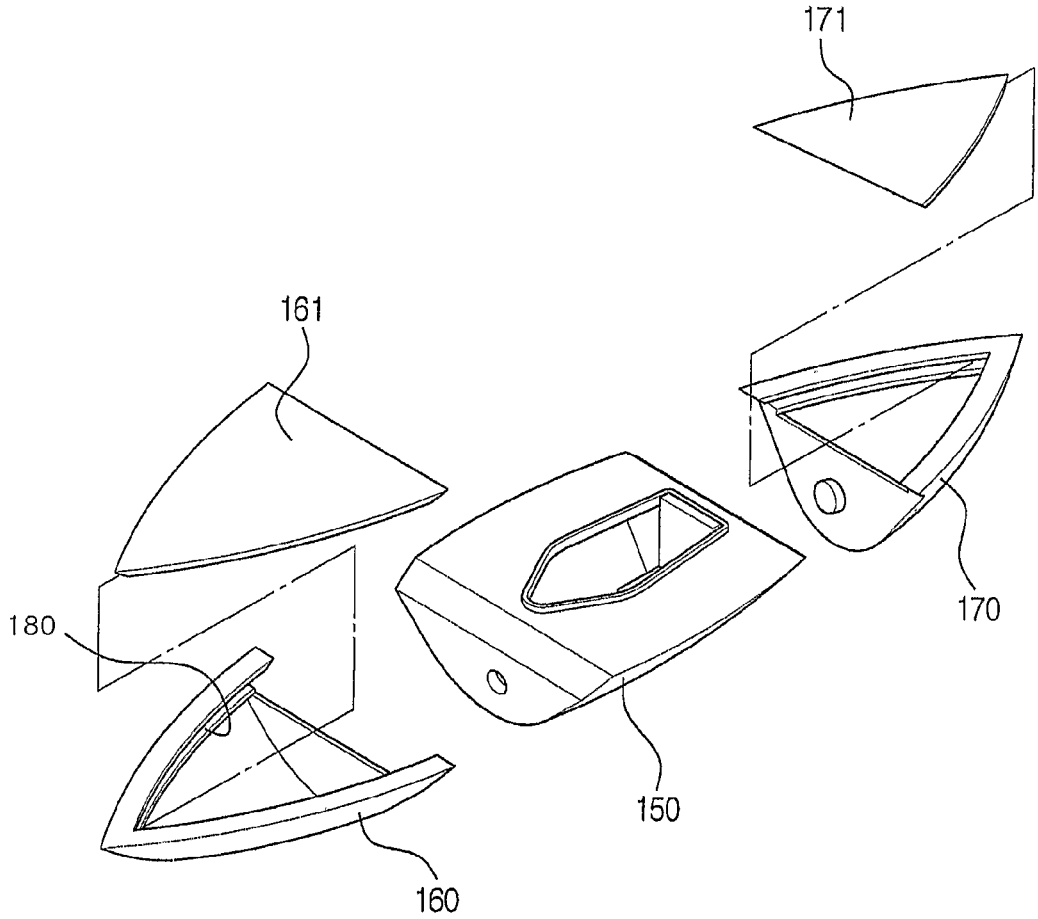

BUILT-UP TYPE BOAT

TECHNICAL FIELD

The present invention relates to a prefabricated boat, which can be conveniently stored and transported, and in particular can be applied to a leisure-purpose small yacht, canoe, kayak, or the like, and also to military-purpose equipment.

BACKGROUND ART

The conventional leisure boat is too expensive for the public users to own, and needs a separate equipment and place in order to transport and store. Therefore, there have been many limitations in using the convention leisure boats. In order to solve these problems, a rubber boat or a small ship capable of assembling has been proposed.

However, in case of the rubber boat, if it has a scratch generated by an external impact, the boat embraces the danger of air leakage all the time. Although its storage and transportation is not difficult, it is a nuisance that air must be injected whenever in use. Similarly, in case of the small ships capable of assembling and disassembling, the assembling and disassembling work is troublesome and needs a separate tool, etc, and thus can be easily owned or used by a general person.

Furthermore, even if the conventional leisure boat or ship can be disassembled or assembled, it is too heavy for a general person to transport by hand in person. Therefore, in case where it is to be used in a canyon or the like, which is not accessible by a car, its transportation is very difficult or inconvenient. Most of the conventional leisure ships are too expensive for general peoples to own. Accordingly, such a leisure involving these boats or ships is limited to people having above a certain level of financial capability.

DISCLOSURE OF INVENTION

The present invention has been made in order to solve the above problems in the art, and it is an object of the invention to provide a prefabricated boat, which can be easily assembled and disassembled.

A second object of the invention is to provide means for minimizing the volume of the boat and enabling easy storage and transportation after disassembled.

A third object of the invention is to provide means for increasing the buoyancy of the boat.

A fourth object of the invention is to provide a prefabricated boat having a lightweight to the extent that a user can hand-carry it.

A fifth object of the invention is to provide means for preventing damages of the boat from an external impact and protecting the passengers safely, when in use.

A sixth object of the invention is to provide a prefabricated boat, which can be owned without any heavy burden by simplifying the structure thereof and thus reducing the manufacturing cost thereof.

A seventh object of the invention is to provide a prefabricated boat having an environmental affinity by using a recyclable material as much as possible.

In order to accomplish the above object, according to one aspect of the invention, there is provided a prefabricated boat. The prefabricated boat of the invention comprises a body part being composed of a plurality of division members capable of being assembled, an armor part for wrapping around and fixing the body part assembled into a single body, and an air tube mounted on a desired position of the inner face of the armor part. The armor part has the form of a bag, and is provided with an opening for receiving the plurality of division members constituting the body part. Air is injected into the air tube to expand it in the state that the armor part wraps around the body part. Due to the expansion force of the air tube, the division members constituting the body part are fixed firmly, thereby preventing the relative movements between the division members. Simultaneously, the buoyancy of the boat is increased and external impact is effectively absorbed to thereby protect the passengers safely.

In addition, one of the division members to be assembled with each other is provided with a convex face formed in one side thereof, and the other division member to be joined with the one division member is provided with a concave face formed in one side thereof. The convex face is composed of an upward slant face and a downward slant face, and the shape of the concave face is corresponding to that of the convex face. The division members are assembled with each other through the interconnection of the convex face and the concave face.

Furthermore, a projection is formed in one of the convex face and the concave face, and a projection receiver for accommodating the projection is formed in the other one of the convex face and the concave. When the convex face and the concave face are engaged, the projection and the projection receiver function to accurately determine their joining position, and after joined, maintain the assembled state with a greater certainty.

BRIEF DESCRIPTION OF DRAWINGS

Further objects and advantages of the invention can be more fully understood from the following detailed description taken in conjunction with the accompanying drawings, in which:

FIG. 1*a* is a perspective view showing an armor part of a prefabricated boat according to one embodiment of the invention;

FIG. 1*b* is a cross-sectional view of the armor part of FIG. 1*a* showing an air bag mounted thereon;

FIG. 2 illustrates schematically an assembling procedure of a prefabricated boat according to one embodiment of the invention;

FIG. 3 illustrates an armor part of the prefabricated boat according to another embodiment of the invention; and FIG. 4 is a schematic view showing a disassembled state of a central portion, a bow portion, and a stern portion of a body part of the prefabricated boat according to the invention.

BEST MODE FOR CARRYING OUT THE INVENTION

The preferred embodiments of the present invention will be hereafter described in detail with reference to the accompanying drawings.

As shown in FIG. 2, a body part of a prefabricated boat according to the invention is composed of a central portion 150, a bow portion 160, and a stern portion 170.

The central portion 150 is provided with a passenger seat therein for accommodating passengers, and constitutes a center of the body part 100. Therefore, the bow portion 160 is assembled to the front side of the central portion 150 and the stern portion 170 is assembled to the rear side of the central portion 150.

Referring to FIG. 2, a convex end face 110 consisted of a upward slant face 111 and a downward slant face 112 is formed respectively in one side of the central portion 150 to which the bow portion 160 is assembled and in the other side thereof to which the stern portion 170 is assembled.

In addition, the respective end face of the bow portion 160 and the stern portion 170 to be assembled to the central portion 150 is provided with a concave end face 120, which corresponds to the shape of the convex end face 110.

Therefore, the convex end face 110 and the concave end face 120 are joined with each other to thereby form the body part 100.

As illustrated in FIG. 2, the concave end face 120 is provided with a projection 130 having a certain height projected from the surface thereof. The convex end face 110 is provided with a projection receiver 140 depressed inwards of the surface thereof for accommodating the projection 130. The position of the projection receiver 140 is corresponding to that of the projection 130.

Due to the inter-engagement of the projection 130 and the projection receiver 140, the joining position can be accurately determined when the convex end face 110 is joined with the concave end face 120. The joined state can be more certainly maintained after the convex end face 110 is joined with the concave end face 120.

In other words, the convex end face 110 of the central portion 150 is contacted with the respective concave end faces 120 of the bow portion 160 and the stern portion 170. If the bow portion 160 and the stern portion 170 are respectively pressed towards the center of the central portion 150, the bow portion 160 and the stern portion 170 are forced to move toward the center. Simultaneously, its vertical motion is restricted due to the action of the upward slant face 111 and the downward slant face 112. Also, owing to the inter-engagement of the projection 130 and the projection receiver 140, the right and left motion thereof is restricted, together with the vertical motion thereof. Therefore, the assembled state of the central portion 150, the bow portion 160, and the stern portion 170 can be stably maintained.

As shown in FIG. 4, a bow top plate 161 constituting the top face of the bow portion 160 and a stern top plate 171 constituting the top face of the stern portion 170 can be detachably structured respectively from the bow portion 160 and the stern portion 170.

Referring to FIG. 4, each of the bow portion 160 and the stern portion 170 is provided with a guide groove 180 formed in the upper peripheral rim thereof such that the bow top plate 161 and the stern top plate 171 can be slidably assembled and disassembled, but not limited thereto. Although not illustrated in the drawings, various ways such as a pin connection, a bolt or screw joint, a prominence and depression engagement, or the like can be applied, as long as they can provide a structure that the bow top plate 161 and the stern top plate 171 are easily assembled to and dissembled from the bow portion 160 and the stern portion 170.

In this way, in case where the bow top plate 161 and the stern top plate 171 are detachably constructed, the bow portion 160 and/or the stern portion 179 can be loaded inside of the central portion 150 in the state that the bow portion 160, the stern portion 170, and the central portion 150 are disassembled.

In other words, although the attached drawings do not clearly show the relative sizes of the bow portion 160, the stern portion 170 and the central portion 150, they are constructed in such a manner that, in the state that they are disassembled, the stern portion 170 with the stern top plate 171 detached therefrom can be loaded inside the central portion 150, and the bow portion 160 with its top plate 161 detached therefrom can be loaded inside the stern portion 170. At the state that the stern portion 170 and the bow portion 160 are loaded in sequence inside the central portion 150, the inner space of the bow portion 160 can be used as various loading spaces. As understood to those skilled in the are, the size of the bow portion 160 and the stern portion 170 can be configured such that first the bow portion 160 with its top plate 161 detached therefrom is loaded inside the central portion 150 and then the stern portion 170 with its top plate 171 is loaded inside the bow portion 160.

The bow portion 160, the stern portion 170, and the central portion 150 having the above-described construction can minimize the space occupied by them when they are disassembled, thereby maximizing the convenience of transportation and storage thereof.

Furthermore, although not illustrated in the drawings, similar to the bow portion 160 or the stern portion 170, the top portion of the central portion 150 can be structured so as to be detachable or disassembled, in order to stack in sequence the bow portion 160 and the stern portion 170 inside the central portion in the same manner as above.

The body part 100 can be made of various materials, for example, woods, aluminum, various synthetic resins such as PET or PVC, composite materials such as carbon fiber or fiberglass. The material for the body part 100 is not particularly limited, but a light and rigid material is preferred.

As shown in FIGS. 1*a* and 1*b*, an armor part 200 has the form of a bag with an opening 220 for receiving the central portion 150, the bow portion, and the stern portion 170 constituting the body part 100. The armor part 200 is provided with an air tube 300 mounted on a desired position inside thereof, and the air tube 300 is expanded when injected with air.

The armor part 200 functions to accommodate the bow portion 160, the stern portion 170, and the central portion 150 constituting the body part 100. At the state that they are received and assembled, the air tube 300 mounted inside the armor part 200 is injected with air and thus expanded. The body part 100 is firmly fixed due to the expansion force of the air tube 300. Simultaneously, the armor part 200 functions to protect the body part 100 from an external impact.

Therefore, the opening 220 provided in the armor part 200 is preferred to have an appropriate range of size such that the components of the body part 100 can be received and, after assembled, a passenger can board in the passenger seat prepared in the central portion 150.

Referring to FIG. 3, the armor part 200 is provided with a connection portion 230, which is extended from a desired position of the periphery of the opening 220 and detachably attached to an opposite facing position. In this way, in case where the connection portion 230 is provided, the opening 220 can be made to have a larger size. Thus, the central portion 150, the bow portion 160 and the stern portion 170 constituting the body part 100 can be more easily accommodated inside the armor part 200. After received, the opening 220 can be tightened using the connection portion 230, thereby carrying out the assembling work of the prefabricated boat of the invention more conveniently.

Although FIG. 3 illustrates a Velcro tape as the connecting means for the connection portion 230 to be attached to the opening 220, a snap button, various belt connectors applied to a climber bag, or the like may be used.

The armor part 200 functions to integrate the body part 100 into a single unit and also to protect the body part 100 by wrapping around the outside thereof.

Therefore, the armor part 200 needs to maintain a desired strength, and thus is preferred to be formed of a reinforced fiber 210, as shown in FIG. 1*a*. The reinforced fiber 210 is made by laminating fibers such as carbon, Kevlar, or the like in various orientations and increases the strength of the armor 200.

As illustrated in FIG. 1*b*, the air tube 300 is mounted inside the armor part 200 and provides a connecting force for fixing the assembled body part 100.

In other words, after the body part 100 is received inside the armor part 200, the air tube 300 is injected with air and the volume of the air tube 300 is expanded. Due to the volume expansion of the air tube 300, a force is exerted to the bow portion 160 and the stern portion 170 such that they are biased towards the center of the central portion 150. Although an air injection hole for injecting air into the air tube 300 is not illustrated in the drawings, it is preferred to be positioned such that the air injection and discharge can be easily carried out.

As described above, when the force is exerted towards the center of the central portion 150, the vertical motion thereof is restricted by means of the action of the upward slant face 111 and the downward slant face 112, and the transversal movement thereof also is restricted by means of the inter-connection of the projection 130 and the projection receiver 140. Therefore, the central portion 150, the bow portion 160, and the stern portion 170 can maintain stably their assembled state.

The attached drawing illustrates that the air tube 300 is provided only in the end portions of the bow portion 160 and the stern portion 170, but not limited thereto. That is, the air tube may be attached to other portions of the armor part 200, when required, and the number of the air tubes is not particularly limited.

In addition, the air tube 300 provides the joining force, and also functions to increase the buoyancy of the prefabricated boat according to the invention.

Simultaneously, the air tube 300 functions to absorb effectively an external impact, so that damage of the body part 100 can be avoided, resultantly thereby facilitating the safety of passengers.

The assembling procedures of the prefabricated boat having the above construction according to the invention will be described below.

In the state that the air tube 300 mounted inside the armor part 200 is not injected with air, the central portion 150, the bow portion 160, and the stern portion 170 constituting the body part 100 are accommodated into the armor part 200 through the opening 220 thereof.

The accommodated central portion 150, the bow portion 160 and the stern portion 170 are assembled to each other in such a way that the projection 140 is received in the projection receiver 130.

At this assembled state, air is injected into the air tube 300 to thereby expand the air tube 300, and thus the central portion 150, the bow portion 160, and the stern portion 170 are firmly fixed, due to the expansion force of the air tube 300.

INDUSTRIAL APPLICABILITY

According to the present invention having the above constitution, the following effects can be achieved.

First, the invention is constructed in such a manner that the body part is wrapped around by the armor part having the form of a bag and having an opening, and the assembled body part is fixed firmly due to the expansion force of the air tube mounted inside the armor part. Any extra tools are not required when assembling and disassembling, and any person can carry out easily the assembling and disassembling thereof.

Second, according to one preferred embodiment of the invention, the bow portion and the stern portion can be accommodated inside the central portion, thereby minimizing the volume thereof and enabling easy storage and transportation after disassembled.

Third, in addition to the buoyancy of the body part itself, the buoyancy thereof can be increased by means of the air tube mounted inside the armor part.

Fourth, the body part, which is a major element of the invention and accounts for most of the weight thereof, is made of a synthetic resin such as PET or a metal such as aluminum having a high specific strength, thereby providing a prefabricated boat having a light weight to the extent that a user can hand-carry it.

Fifth, the present invention is structured in such a way that the armor part formed of a reinforced fiber waterproof-treated wraps around the body part, thereby preventing damages of the body part from an external impact and protecting the passengers safely, when in use.

Sixth, as described above, the present invention has a simplified structure, so that a competitive price can be achieved from reduction in the manufacturing cost thereof, thereby providing a prefabricated boat, which can be owned without any heavy burden.

Seventh, a recyclable material such as PET is used as much as possible, thereby providing a prefabricated boat having an environmental affinity.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A prefabricated boat comprising:

a) a body part being composed of a plurality of division members capable of being assembled;

b) an armor part for wrapping around and fixing the body part assembled into a single body; and c) an air tube mounted on a desired position of an inner face of the armor part;

d) wherein the armor part has the form of a bag, the armor part being provided with an opening for receiving the plurality of division members constituting the body part, wherein one division member of the plurality of division members to be assembled with each other is provided with a convex face formed in one side thereof, the convex face being composed of an upward slant face and a downward slant face, and the other division member to be joined with the one division member is provided with a concave face formed in one side thereof, the shape of the concave face being corresponding to that of the convex face.

2. The prefabricated boat according to claim 1, wherein a projection is formed in one of the convex face and the concave face, and a projection receiver for accommodating the projection is formed in the other one of the convex face and the concave face.

3. The prefabricated boat according to claim 2, wherein the division members constituting the body part comprise:

a) a central portion having a passenger seat for accommodating a passenger;

b) a bow portion to be assembled to one side of the central portion; and c) a stern portion to be assembled to the other side of the central portio;

d) wherein a bow top plate constituting the top face of the bow portion and a stern top plate constituting the top face of the stern portion can be detachably assembled respectively to the bow portion and the stern portion.

4. The prefabricated boat according to claim 1, wherein the division members constituting the body part comprises:

a) a central portion having a passenger seat for accommodating a passenger;

b) a bow portion to be assembled to one side of the central portion; and c) a stern portion to be assembled to the other side of the central portion;

d) wherein a bow top plate constituting the top face of the bow portion and a stern top plate constituting the top face of the stern portion can be detachably assembled respectively to the bow portion and the stern portion.

5. The prefabricated boat according to claim 4, wherein the size of the central portion, the bow portion, and the stern portion is configured such that one of the bow portion and the stern portion can be accommodated into the other one thereof, and then the bow portion with the stern portion accommodated therein or vice versa can be accommodated into the central portion.

6. The prefabricated boat according to claim 1, wherein the armor part is formed of reinforced fibers waterproof-treated.

7. The prefabricated boat according to claim 1, wherein the armor part is further provided with a connection portion, which is extended from a desired position of the periphery of the opening and detachably attached to an opposite facing position of the periphery of the opening.

* * * * *